US006231462B1

(12) United States Patent
Yamagishi et al.

(10) Patent No.: US 6,231,462 B1
(45) Date of Patent: May 15, 2001

(54) SOLID GOLF BALL

(75) Inventors: Hisashi Yamagishi; Hiroshi Higuchi; Junji Hayashi, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/369,023

(22) Filed: Aug. 6, 1999

(30) Foreign Application Priority Data

Aug. 7, 1998 (JP) ..... 10-224712

(51) Int. Cl.[7] ..... A63B 37/12

(52) U.S. Cl. ..... 473/378; 473/377

(58) Field of Search ..... 473/376, 377, 473/378

(56) References Cited

U.S. PATENT DOCUMENTS 5,255,922 * 10/1993 Proudfit ..... 473/376
5,607,366 * 3/1997 Yokota et al. ..... 473/377

* cited by examiner

*Primary Examiner*—Mark S. Graham
*Assistant Examiner*—Raeann Gorden
(74) *Attorney, Agent, or Firm*—Sughrue, Mion, Zinn, Macpeak & Seas, PLLC

(57) ABSTRACT

The invention provides a solid golf ball comprising a solid core and a cover of one or more layers, or a solid golf ball comprising a solid core, an intermediate layer, and a cover of one or more layers. When the ball is hit with a driver at a head speed of 45 m/sec, the maximum contact area S ($cm^2$) and the contact time t ($\mu$sec) of the ball with the club upon impact should satisfy the relationship: $9.0 \leqq (S/t) \times 1000 \leqq 11.0$. The golf ball has excellent flight performance and a soft and pleasant feel indicative of speed.

15 Claims, 2 Drawing Sheets

SOLID GOLF BALL

This invention relates to a solid golf ball having a soft and pleasant feel indicative of speed.

BACKGROUND OF THE INVENTION

Many solid golf balls such as two-piece golf balls are known in the art. As compared with the wound golf balls, solid golf balls have the advantage of an increased total flight distance on both driver and iron shots, because of a so-called straight line trajectory and a low spin rate due to their structure, which in turn allows for a long run. On the other hand, solid golf balls are more difficult to control than wound golf balls in that they do not stop short on the green because of low spin receptivity on iron shots.

Like flight distance, a pleasant feel (softness and speed impression) when hit is essential for golf balls. The absence of a pleasant feel represents a substantial loss of commodity value for the golf ball. As compared with the solid golf balls, the wound golf balls have the structural characteristics ensuring a soft and pleasant feel with a speed impression.

On such solid golf balls, especially two-piece golf balls consisting of a core and a cover, attempts have been made to soften the ball structure in order to accomplish a soft feel upon impact. However, such attempts improve the feel to a softer one at the sacrifice of a speed impression. A blunt feel is given when the ball is hit. Additionally, a loss of resilience leads to a reduction of flight distance.

SUMMARY OF THE INVENTION

An object of the invention is to provide a solid golf ball which when hit, gives a soft and pleasant feel indicative of speed while maintaining the excellent flight performance of solid golf balls.

The inventor examined the behavior of a solid golf ball when struck with a club. Making a quantitative analysis on the relationship between the contact time and the maximum contact area upon impact, the inventor has found that a solid golf ball satisfying a specific relationship between the contact time and the maximum contact area gives a soft and pleasant feel indicative of speed.

The invention is directed to a solid golf ball comprising a solid core and a cover of at least one layer around the core, or a solid golf ball comprising a solid core, an intermediate layer around the core, and a cover of at least one layer around the intermediate layer. When the ball is hit with a driver at a head speed of 45 m/sec, the maximum contact area S ($cm^2$) and the contact time t ($\mu$sec) of the ball with the club upon impact should satisfy the relationship: $(S/t)\times 1000 \geqq 9.0$. Then the solid golf ball has not only excellent flight performance, but also a soft and pleasant feel indicative of speed surpassing the feel of wound golf balls.

Preferably the value of $(S/t)\times 1000$ is from 9.0 to 11.0. Also preferably, the contact time t is 400 to 570 $\mu$sec and the maximum contact area S is 3.5 to 5.5 $cm^2$. Further preferably, the solid core is formed mainly of cis-1,4-polybutadiene rubber and the outermost layer of the cover is formed mainly of a thermoplastic resin.

DESCRIPTION OF THE PREFERRED EMBODIMENTS

Figure 1:
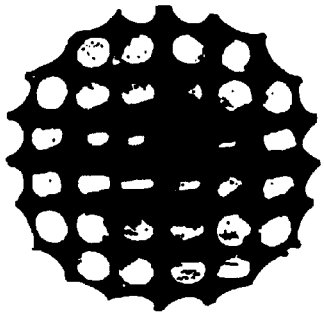
FIGS. 1 to 3 are schematic views illustrating how to determine the maximum contact area of a golf ball with a club.

The solid golf ball according to the first aspect of the invention has a solid core and a cover of one or more layers surrounding the core. In the second aspect, the solid golf ball has a solid core, an intermediate layer surrounding the core, and a cover of one or more layers surrounding the intermediate layer. In either case, the ball satisfies the relationship: $(S/t)\times 1000 \geqq 9.0$ wherein S and t are the maximum contact area ($cm^2$) and contact time (psec), respectively, upon impact when the ball is hit with a driver at a head speed of 45 m/sec.

The solid core may be formed of a rubber composition primarily comprising a base rubber which is based on polybutadiene rubber, polyisoprene rubber, natural rubber or silicone rubber. Polybutadiene rubber is preferred especially for improved resilience. The preferred polybutadiene rubber is cis-1,4-polybutadiene containing at least 40% cis structure. In the base rubber, another rubber component such as natural rubber, polyisoprene rubber or styrene-butadiene rubber may be blended with the polybutadiene if desired. For high resilience, the other rubber component should preferably be less than about 10 parts by weight per 100 parts by weight of polybutadiene.

In the rubber composition, a crosslinking agent may be blended with the rubber component. Exemplary crosslinking agents are zinc and magnesium salts of unsaturated fatty acids such as zinc methacrylate and zinc acrylate, and esters such as trimethylpropane methacrylate. Of these, zinc acrylate is preferred because it can impart high resilience. The crosslinking agent is preferably used in an amount of about 15 to 40 parts by weight per 100 parts by weight of the base rubber. A vulcanizing agent such as dicumyl peroxide may also be blended in the rubber composition, preferably in an amount of about 0.1 to 5 parts by weight per 100 parts by weight of the base rubber. In the rubber composition, an antioxidant and a specific gravity adjusting filler such as zinc oxide or barium sulfate may be blended. The amount of filler blended is 0 to about 130 parts by weight per 100 parts by weight of the base rubber.

One preferred formulation of the solid core-forming rubber composition is given below.

| | Parts by weight |
|---|---|
| Cis-1,4-polybutadiene | 100 |
| Zinc oxide | 5 to 40 |
| Zinc acrylate | 15 to 40 |
| Barium sulfate | 0 to 40 |
| Peroxide | 0.1 to 5.0 |
| Antioxidant | appropriate |

Vulcanizing conditions include a temperature of 150±10° C. and a time of about 5 to 20 minutes.

The rubber composition is obtained by kneading the above-mentioned components in a conventional mixer such as a kneader, Banbury mixer or roll mill. The resulting compound is molded in a mold by injection or compression molding.

Preferably the solid core has a diameter of 28 to 38 mm, more preferably 30 to 37 mm.

The core should preferably have a deflection of 2.0 to 6.0 mm, more preferably 2.3 to 5.5 mm under an applied load of 100 kg. The core is usually formed to a single layer structure from one material although it may also be formed to a multilayer structure of two or more layers of different materials if desired.

In the first aspect, a cover of one or more layers is formed around the core. In the second aspect, an intermediate layer is formed around the core, and a cover of one or more layers is formed around the intermediate layer.

The intermediate layer is composed mainly of a thermoplastic resin, examples of which include polyester elastomers, ionomer resins, styrene elastomers, urethane resins, hydrogenated butadiene resins and mixtures thereof. Of these, the ionomer resins are preferred. Use may be made of commercially available ionomer resins such as "Surlyn" from Dupont and "Himilan" from Mitsui-Dupont Polychemical K.K. To the intermediate layer composition, there may be added antioxidants and dispersants such as metal soaps, if necessary.

Any desired method may be used in forming the intermediate layer around the core. Conventional injection or compression molding may be employed.

The intermediate layer preferably has a thickness of 0.5 to 4.0 mm, more preferably 0.8 to 4.0 mm and a Shore D hardness of 40 to 68. The intermediate layer may be formed from plural layers of different materials.

The cover is made of a cover stock based on a thermoplastic resin. When the cover consists of two or more layers, the outermost layer is preferably formed of a thermoplastic resin. (When the cover is one layer, the outermost layer is the cover itself.) Examples of the thermoplastic resin include polyester elastomers, ionomer resins, styrene elastomers, urethane resins, hydrogenated butadiene resins and mixtures thereof. Such thermoplastic resins are commercially available under the trade name of "Himilan" from Mitsui-Dupont Polychemical K.K., "Surlyn" from Dupont, "Hytrel" from Toray-Dupont K.K., "Glylux" and "Pandex" from Dai-Nippon Ink & Chemicals K.K.

The cover is formed of one or more layers. When the cover is a two-layer structure consisting of inner and outer layers, the cover inner layer is formed of a relatively soft cover stock, for example, a polyester elastomer or polyurethane elastomer, and the cover outer layer is formed of a relatively hard cover stock, for example, an ionomer resin. To the cover stock, there may be added UV absorbers, antioxidants and dispersants such as metal soaps, if necessary.

Any desired method may be used in forming the cover around the core or intermediate layer. Conventional injection or compression molding may be employed.

When the cover is formed of one layer, its thickness is preferably 0.5 to 2.5 mm, more preferably 0.8 to 2.3 mm and its Shore D hardness is preferably 50 to 70, more preferably 55 to 68.

For the two-layer structure wherein the cover is formed of two layers, the cover inner layer preferably has a thickness of 0.5 to 2.5 mm, more preferably 0.8 to 2.3 mm and the cover outer layer preferably has a thickness of 0.5 to 2.5 mm, more preferably 0.8 to 2.3 mm.

In the three-layer structure wherein the cover consists of an outermost layer, a middle layer, and an inner layer, the outermost layer may be formed as is the outer layer of the two-layer structure, and the middle and inner layers may be formed as is the inner layer of the two-layer structure.

The golf ball of the above construction should satisfy the relationship: $(S/t)\times1000 \geqq 9.0$ wherein S and t are the maximum contact area ($cm^2$) and contact time ($\mu$sec), respectively, upon impact when the ball is hit with a driver (Wood No. 1 club, W#1) at a head speed of 45 m/sec. Preferably the value of $(S/t)\times1000$ is in the range from 9.0 to 11.0.

The maximum contact area S of the ball with the club is obtained by examining the deformation state of the golf ball when actually hit with the driver, using pressure-sensitive paper.

Figure 2:
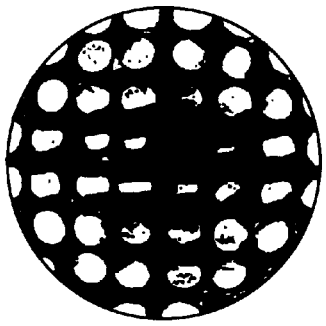

More particularly, a swing robot is equipped with a driver (W#1), and a pressure-sensitive paper strip is attached to the club face of the driver. A ball is hit with the driver at a head speed of 45 m/sec. Then the ball impresses an image of its contacting portion on the surface of the pressure-sensitive paper as shown in FIG. 1. The impression of FIG. 1 has an outer periphery which is corrugated because of circular dimples positioned along the periphery which partially wane. The impression of FIG. 1 is trimmed to depict a picture having a substantially circular periphery as shown in FIG. 2.

Figure 3:
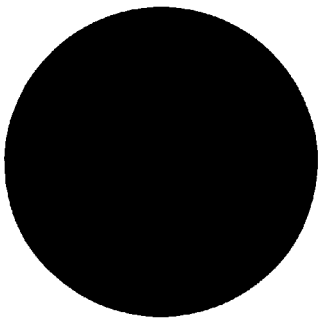

The interior of the trimmed picture is inked black as shown in FIG. 3. The picture of FIG. 3 is imaged by a CCD camera and subjected to image processing or binarization, from which the maximum contact area S is determined. The maximum contact area S thus determined is 3.5 to 5.5 $cm^2$, preferably 3.8 to 5.2 $cm^2$.

Figure 4:
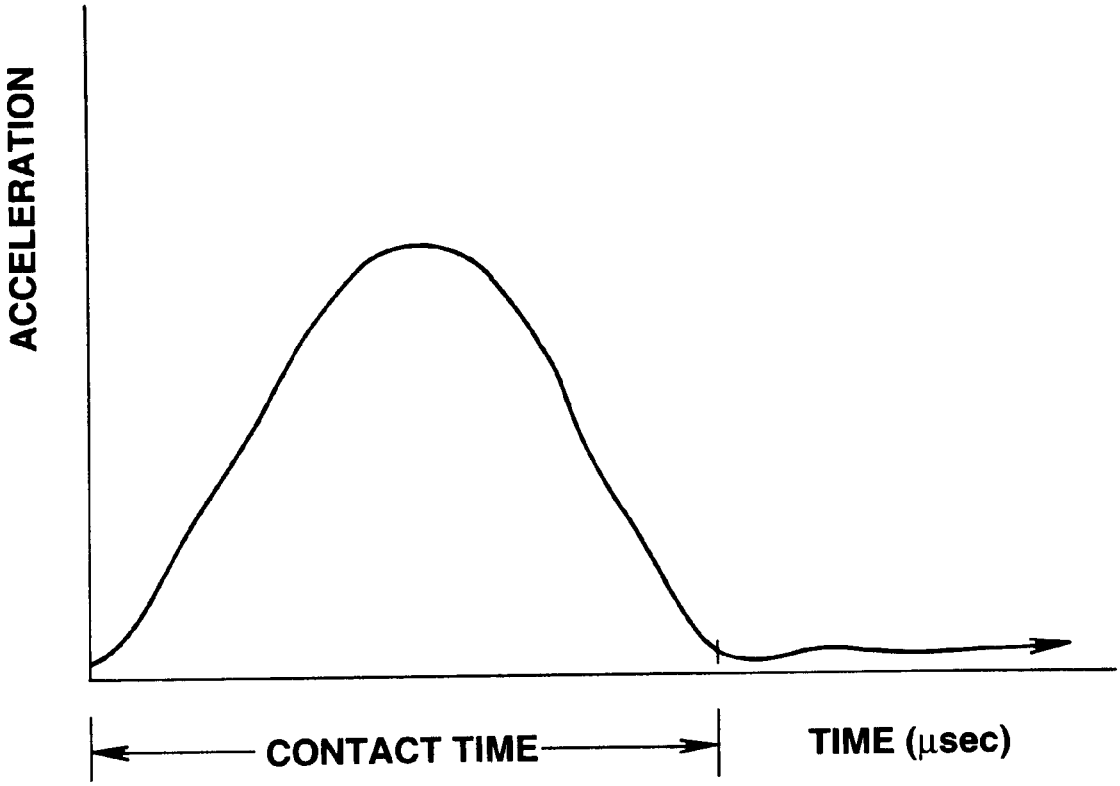
FIG. 4 is a graph showing the acceleration vs. time hen a golf ball is hit with a club, illustrating how to determine the contact time.

The contact time t is determined in the same step of striking the ball with a driver (W#1) at a head speed of 45 m/sec. A piezoelectric acceleration pickup is affixed to the club face of the driver. When the ball is struck with the club, the acceleration of the club is measured through a 5-kHz low-pass filter. The acceleration measurements are plotted as a function of time, obtaining a diagram of FIG. 4. From the waveform, the contact time t is determined. The contact time t thus determined is 400 to 570 $\mu$sec, preferably 420 to 550 $\mu$sec.

The golf ball of the invention is provided on its surface with a multiplicity of dimples. Typically the ball surface is subject to various finish treatments including stamping and paint coating. The golf ball as a whole preferably has a hardness corresponding to a deflection of 2.6 to 5.0 mm, more preferably 2.8 to 4.8 mm, under a load of 100 kg. The golf ball must have a diameter of not less than 42.67 mm and a weight of not greater than 45.93 grams in accordance with the Rules of Golf.

When hit, the solid golf ball of the invention exhibits excellent flight performance and gives a soft and pleasant feel indicative of speed.

EXAMPLE

Examples of the invention are given below by way of illustration and not by way of limitation. All parts are by weight.

Examples 1–4 & Comparative Examples 1–3

Core-forming rubber compositions of the formulation shown in Table 1 were mixed in a kneader and molded and vulcanized in a core mold at a temperature of 155° C. for about 15 minutes, forming solid cores.

Around the cores, the intermediate layer and cover were formed by injection molding the intermediate layer material and cover material of the formulation shown in Table 2 in accordance with the combination shown in Table 3, obtaining solid golf balls of Examples 1–4 and Comparative Examples 1–3. It is noted that Comparative Examples 1–3 are two-piece golf balls consisting of the core and the cover (lacking the intermediate layer and cover inner layer).

The golf balls were examined for core hardness, maximum contact area, contact time, and feel by the following tests. The results are shown in Table 3.

Core hardness

The hardness was represented by a deflection (mm) of the core under a load of 100 kg.

Maximum contact area S

A swing robot (by Miyamae K.K.) was equipped with a driver (PRO 230 Titan, loft angle 10°, S shaft, by Bridgestone Sports Co., Ltd.). A pressure-sensitive paper strip ("Pershot" by Lite Shokai K.K.) was attached to the club face of the driver. The ball was struck with the driver at a head speed of 45 m/sec. By the above-described procedure, the maximum contact area S was determined.

Contact time t

A swing robot (by Miyamae K.K.) was equipped with a driver (PRO 230 Titan, loft angle 10°, S shaft, by Bridgestone Sports Co., Ltd.). A piezoelectric acceleration pickup #4393 (by Bruel & Kjaer) was affixed to the club face of the driver. The ball was struck with the driver at a head speed of 45 m/sec. By the above-described procedure, the contact time t was determined.

Feel

Four professional golfers actually hit the ball and evaluated according to the following criterion.

O: soft and repulsive

X: soft, but blunt

TABLE 1

| | Solid core | | | | | | |
|---|---|---|---|---|---|---|---|
| | Example | | | | Comparative Example | | |
| | 1 | 2 | 3 | 4 | 1 | 2 | 3 |
| Cis-1,4-polybutadiene | 100 | 100 | 100 | 100 | 100 | 100 | 100 |
| Zinc acrylate | 22.5 | 23.0 | 24.0 | 25.0 | 24.5 | 23.0 | 22.0 |
| Dicumyl peroxide | 1.2 | 1.2 | 1.2 | 1.2 | 1.2 | 1.2 | 1.2 |
| Antioxidant | 0.1 | 0.1 | 0.1 | 0.1 | 0.1 | 0.1 | 0.1 |
| Zinc oxide | 5.0 | 5.0 | 5.0 | 5.0 | 5.0 | 5.0 | 5.0 |
| Barium sulfate | 33.9 | 27.3 | 29.6 | 24.4 | 17.4 | 18.1 | 18.5 |
| Diameter (mm) | 32.1 | 32.1 | 32.1 | 34.7 | 38.7 | 38.7 | 38.7 |
| Hardness (mm) | 3.4 | 3.3 | 2.8 | 2.5 | 2.8 | 3.2 | 3.6 |

TABLE 2

| | Intermediate layer and cover | | | | | |
|---|---|---|---|---|---|---|
| | A | B | C | D | E | F |
| Himilan 1706 | 50 | — | — | — | — | — |
| Himilan 1605 | 50 | — | — | — | — | — |
| Himilan 1650 | — | 50 | — | — | — | — |
| Surlyn 1856 | — | 50 | — | — | — | — |
| Hytrel 4047 | — | — | — | — | 100 | — |
| Hytrel 3078 | — | — | 100 | — | — | 70 |
| Hytrel G3548L | — | — | — | 100 | — | — |
| Glylux E100 | — | — | — | — | — | 30 |
| Hardness (Shore D) | 65 | 60 | 30 | 35 | 40 | 25 |

Himilan is the trade name of ionomer resin by Mitsui-Dupont Polychemical K.K.; Surlyn is the trade name of ionomer resin by Dupont; Hytrel is the trade name of thermoplastic polyester elastomer by Toray-Dupont K.K.; and Glylux is the trade name of thermoplastic elastomer by Dai-Nippon Ink & Chemicals K.K.

TABLE 3

| | | Example | | | | Comparative Example | | |
|---|---|---|---|---|---|---|---|---|
| | | 1 | 2 | 3 | 4 | 1 | 2 | 3 |
| Core hardness (mm) | | 3.4 | 3.3 | 2.8 | 2.5 | 2.8 | 3.2 | 3.6 |
| Intermediate layer | Material type | A | A | B | — | — | — | — |
| | Thickness (mm) | 1.5 | 1.5 | 1.5 | — | — | — | — |
| | Hardness (Shore D) | 65 | 65 | 60 | — | — | — | — |
| Cover inner layer | Material type | C | D | E | F | — | — | — |
| | Thickness (mm) | 2.0 | 2.0 | 2.0 | 2.0 | — | — | — |
| | Hardness (Shore D) | 30 | 35 | 40 | 25 | — | — | — |
| Cover outer layer | Material type | B | A | A | A | A | A | A |
| | Thickness (mm) | 1.8 | 1.8 | 1.8 | 2.0 | 2.0 | 2.0 | 2.0 |
| | Hardness (Shore D) | 60 | 65 | 65 | 65 | 65 | 65 | 65 |
| Ball | Contact time t (μsec) | 500 | 480 | 450 | 430 | 440 | 468 | 510 |
| | Contact area S ($cm^2$) | 4.6 | 4.8 | 4.6 | 4.1 | 3.8 | 4.1 | 4.5 |
| | (S/t)x1000 | 9.2 | 10.0 | 10.2 | 9.5 | 8.6 | 8.8 | 8.8 |
| | Feel | ○ | ○ | ○ | ○ | X | X | X |

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A solid golf ball comprising; a solid core formed of rubber and a cover formed of a thermoplastic resin around the core said cover composed of an inner layer formed of a relatively soft cover stock and an outer layer formed of a relatively hard cover stock, wherein the ball satisfies the relationship: $(S/t)\times1000 \geqq 9.0$ wherein S and t are the maximum contact area ($cm^2$) and contact time (μsec), respectively, upon impact when the ball is hit with a driver at a head speed of 45 m/sec.

2. The golf ball of claim 1 wherein said solid core is formed mainly of cis-1, 4-polybutadiene rubber.

3. The golf ball of claim 1 wherein the contact time t is 400 to 570 μsec.

4. The golf ball of claim 1 wherein the maximum contact area S is 3.5 to 5.5 $cm^2$.

5. The golf ball of claim 1 wherein the value of $(S/t)\times1000$ is in the range of 9.0 to 11.0.

6. The golf ball of claim 1, wherein said inner layer of the cover is formed of polyester elastomer or polyurethane elastomer and said outer layer of the cover is formed of ionomer resin.

7. The golf ball of claim 1, wherein said inner layer of the cover has a thickness of 0.5 to 2.5 mm.

8. The golf ball of claim 1, wherein said outer layer of the cover has a thickness of 0.5 to 2.5 mm.

9. The golf ball of claim 1, wherein said inner layer of the cover has a Shore D hardness of 25 to 40.

10. The golf ball of claim 1, wherein said outer layer of the cover has a Shore D hardness of 60 to 65.

11. The golf ball of claim 1, wherein said core has a deflection of 2.0 to 6.0 mm under an applied load of 100 kg.

12. The golf ball of claim 1, further comprising an intermediate layer formed of thermoplastic resin is interposed between said core and said inner layer of the cover.

13. The golf ball of claim 12, wherein said intermediate layer has a Shore D hardness harder than said inner layer of the cover.

14. The golf ball of claim 12, wherein said intermediate layer has a Shore D hardness substantially equal to the hardness of the said outer layer of the cover.

15. The golf ball of claim 12, wherein said intermediate layer has a thickness of 0.5 to 4.0 mm.

* * * * *